US006535165B2

(12) United States Patent
Stephens

(10) Patent No.: US 6,535,165 B2
(45) **Date of Patent: *Mar. 18, 2003**

(54) PHASED ARRAY ANTENNA BEAMFORMER

(75) Inventor: Ronald Regis Stephens, Westlake Village, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/003,396

(22) Filed: Oct. 22, 2001

(65) Prior Publication Data

US 2002/0075183 A1 Jun. 20, 2002

Related U.S. Application Data

(62) Division of application No. 09/383,819, filed on Aug. 26, 1999, now Pat. No. 6,348,890.

(51) Int. Cl.[7] ..... H01Q 3/22
(52) U.S. Cl. ..... 342/375
(58) Field of Search ..... 342/368–377

(56) References Cited

U.S. PATENT DOCUMENTS

| | | | | |
|---|---|---|---|---|
| 4,725,844 A | | 2/1988 | Goodwin et al. | 342/374 |
| 5,369,410 A | * | 11/1994 | Reich | 342/368 |
| 5,374,935 A | * | 12/1994 | Forrest | 342/375 |
| 5,475,392 A | * | 12/1995 | Newberg et al. | 342/375 |
| 5,631,758 A | | 5/1997 | Knox et al. | 359/127 |
| 5,859,719 A | | 1/1999 | Dentai et al. | 359/171 |
| 5,861,845 A | | 1/1999 | Lee et al. | 342/375 |
| 5,926,298 A | | 7/1999 | Li | 359/120 |
| 5,999,128 A | | 12/1999 | Stephens et al. | 342/375 |
| 6,181,449 B1 | | 1/2001 | Taga et al. | 359/124 |
| 6,198,721 B1 | | 3/2001 | Mueller | 370/223 |
| 6,204,944 B1 | | 3/2001 | Uchiyama et al. | 359/123 |
| 6,208,444 B1 | | 3/2001 | Wong et al. | 359/127 |
| 6,229,937 B1 | | 5/2001 | Nolan et al. | 385/24 |
| 6,348,890 B1 | * | 2/2002 | Stephens | 342/375 |

FOREIGN PATENT DOCUMENTS

| | | |
|---|---|---|
| EP | 0 392 416 A1 | 10/1990 |
| EP | 0 664 465 A2 | 7/1995 |
| WO | 01/15269 A1 | 3/2001 |

OTHER PUBLICATIONS

Gopalakrishnan, G.K., et al., "Microwave–Optical Mixing in $LiNbO_3$ Modulators," *IEEE Transactions on Microwave Theory and Techniques*, vol. 41, No. 12, pp. 2383–2391 (Dec. 1993).

Logan, Jr., R.T., et al., "Millimeter–Wave Photonic Downconvertors: Theory and Demonstrations," *Proceedings of SPIE Conference on Optical Technology for Microwave Applications VII*, San Diego, CA, 12 pages (Jul. 9–14, 1995).

Stimson, G.W., *Introduction to Airborne Radar*, Second Edition, SciTech Publishing, Mendham, NJ, Chapter 40, p. 513 (1998).

* cited by examiner

*Primary Examiner*—Thomas H. Tarcza
*Assistant Examiner*—Fred H Mull
(74) *Attorney, Agent, or Firm*—Ladas & Parry

(57) ABSTRACT

A method and apparatus for phased array antenna beamforming. An incoming electrical wavefront is received by an antenna. Laser light is amplitude modulated to provide a synthesized optical wavefront beam. The synthesized optical wavefront is mixed with the incoming electrical wavefront by optical modulation to provide a resultant optical waveform tilted to a coarse scan angle. The resultant optical waveform is transmitted to a predetermined delay line to provide an electrical output from the predetermined delay line corresponding to a main lobe of the resultant optical waveform.

21 Claims, 9 Drawing Sheets

60
62
64
66
68
70
72
74
76a
76b
76c
78a
78b
78c
PORT A
PORT B
PORT C
BROADSIDE
+Γ
-Γ
$f_0$
$f_{LO}$
$f_{IF}$
+θ
-θ, -θ ± Γ
Line-By-Line Mixing of Incoming $f_0$ with $f_{LO}$
Analog or Digital Beam-Forming Circuit

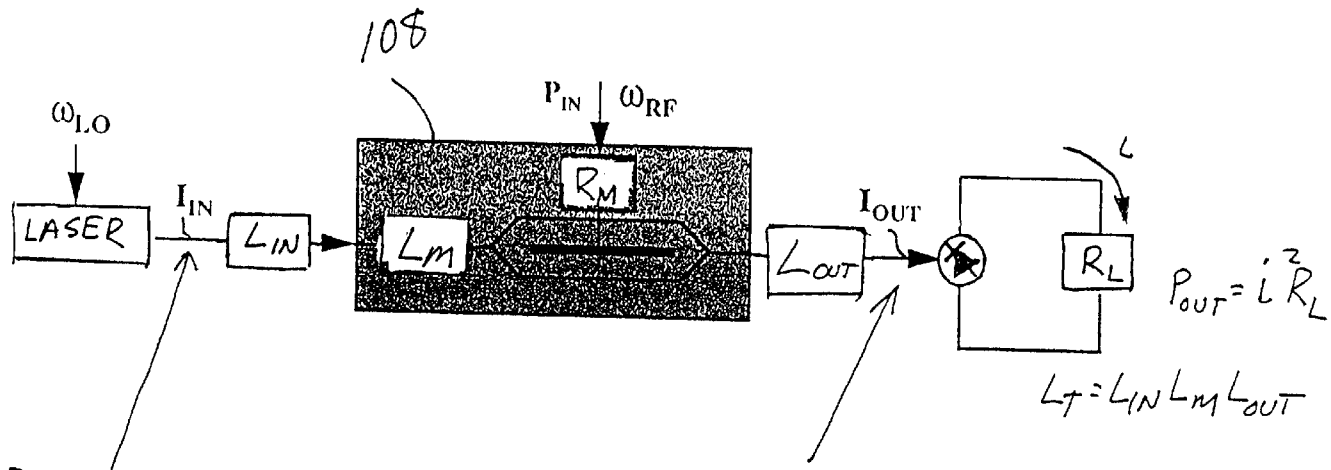

WHERE $$I_{IN} = I_0\left[1 + M\cos(\omega_{LO}t + \phi)\right] \qquad I_{OUT} = \frac{I_{IN}}{2L_T}(1 + m\sin\omega_{RF}t)$$

Photocurrent:

$$i = \frac{rI_0}{2L_T}\left\{1 + m\sin(\omega_{RF}t) + M\cos(\omega_{LO}t + \phi) \pm \frac{1}{2}mM\sin\left[(\omega_{LO} \pm \omega_{RF})t + \phi\right]\right\}$$

Average — RF term — LO — Mixing (IF) terms

Relative IF Conversion Loss:

$$\frac{P_{OUT}(IF)}{P_{OUT}(RF)} = \left(\frac{\text{IF term}}{\text{RF term}}\right)^2 = \frac{M^2}{4} = -6\text{ dB}$$

Relative to non-converting link when M=1 ($0 \le M \le 1$)

FIG 9

PHASED ARRAY ANTENNA BEAMFORMER

This is a divisional of U.S. Ser. No. 09/383,819 filed on Aug. 26, 1999, now U.S. Pat. No. 6,348,890 B1.

FIELD OF THE INVENTION

This invention relates to the field of phased array antennas, and, more particularly, to a method and apparatus for antenna beamforming.

BACKGROUND OF THE INVENTION

Phased array antenna systems are widely used in radar, electronic warfare and high data-rate communications applications. A portion of a conventional multibeam phased array antenna system 20 is shown in FIG. 1. The antenna system includes a plurality of radiators 22 that are arranged along an array face 24. The radiator array is typically divided into subarrays. For example, the array might contain 1024 radiators that are divided into four subarrays that each contain 256 radiators. The term radiator is used to refer to both the transmitter and receiver aspect of the antenna system. For simplicity, FIG. 1 illustrates a single 16 element row in one of these subarrays. In each row, each radiator 22 is coupled by a power amplifier 28 to a respective multiplexer 30. Each radiated beam is associated with a different manifold 32 that has a primary transmission line 34 which branches into secondary transmission lines 36 that each couple to a respective one of the multiplexers 30. A programmable delay line 38 is inserted into the primary transmission line 34 and a filter 40 and an adjustable electrical phase shifter 42 are inserted into each secondary transmission line 36. For clarity of illustration, each primary transmission line is labeled with the number of its respective antenna beam.

Operation of the phased array antenna can be separated into coarse and fine beam pointing processes. In a coarse beam pointing process, an appropriate time delay is programmed into each beam #1 delay line of the four subarrays. These time delays generate a selected coarse phase front (e.g., the coarse phase front 44) across the antenna array and, accordingly, a #1 antenna beam is radiated orthogonally to that coarse phase front. In a fine beam pointing process, appropriate phase shifts are selected with the phase shifters 42 that are associated with the manifold of beam #1. These phase shifts modify the coarse phase front to generate a fine phase front (e.g., the fine phase front 46) across the antenna array and, accordingly, the #1 antenna beam is radiated orthogonally to that phase front. This operational process is repeated for each of the other beams, i.e., beams #2, #3 and #4.

However, when data (e.g., pulses) are placed on the radiated signals, the signal spectrum is widened. This can lead to an undesirable increase in beam divergence. This undesirable beam broadening in wide bandwidth signals is commonly referred to as "beam squint". In the antenna 20 of FIG. 1, the delay lines 38 insert an appropriate time delay to form the coarse wavefront 44. Each radiated beam is preferably coarsely steered to a nominal beam angle and then finely steered about this nominal angle. The coarse steering will not induce beam squint but the fine steering will. It can be appreciated, therefore, that it would be advantageous to have phased array structures that generate antenna beams that have low values of beam squint.

One approach which provides for a wideband phased array antenna system that has less beam squint than conventional antennas is set forth in U.S. Pat. No. 5,861,845, entitled "Wideband Phased Array Antennas and Methods" (hereinafter the '845 patent), which is incorporated herein by reference. Such antennas have no beam squint at the selectable scan angles. Although beam squint increases as the scan angle is varied in response to the frequency of the scanning signal, this increase is controlled by increasing the number of reference differential time delays. In contrast to conventional phased-array antennas, antennas of the type set forth in the '845 patent have significantly reduced packaging complexity at the array face and are considered an improvement over conventional phased array antennas.

In reviewing the '845 antenna system in more detail, the antenna system includes an electronic signal generator, reference and scanning manifolds and an array of radiative modules. In transmit mode, the signal generator generates a variable-frequency scanning signal and a reference signal wherein the frequency of the reference signal is substantially a selected one of the sum and the difference of the frequencies of the scanning signal and an operating signal. A reference manifold receives and divides the reference signal into reference signal samples which are progressively time delayed by a selectable one of reference differential time delays. A scanning manifold receives and divides the scanning signal into scanning signal samples which are progressively time delayed by a scanning differential time delay. Each of the radiative modules includes a mixing device, an electromagnetic radiator and a filter. The mixing device receives and mixes a respective one of the reference signal samples and a respective one of the scanning signal samples. The filter couples the mixing device to the radiator and is configured to pass the operating signal. Accordingly, an antenna beam is radiated from the array at selectable scan angles with each of the scan angles varying in response to the frequency of the scanning signal.

In receive mode, operational signals received by the radiators enter mixers and are converted to reference signals with scanning signals that are generated by optical detectors. The converted reference signals are then placed on optical carrier signals in optical signal generators and sent through programmable delay lines. The delayed signals are then detected in optical detectors and combined in a corporate feed to produce a coherent vector sum at a feed output. When receiving incoming operational signals, the delay lines are also programmed as in the transmit operation of the reference manifold. However, in contrast, they are programmed to form conjugate manifolds (e.g., if the manifolds are programmed to generate a transmit beam having a transmit beam angle, they are subsequently programmed to form a receive manifold having a receive beam angle that is the conjugate of the transmit beam angle).

Referring to FIG. 2, a receiver implementation of the invention of the '845 patent is shown. The scanning manifold described in the '845 patent generates the local oscillator wavefront $S_s$. This wavefront is photodetected line-for-line, amplified, then electrically mixed line-for-line with incoming wavefront SO by subsystem 50 (located at the antenna backplane) to produce an IF wavefront which has a frequency $S_r$. In line switched programmable delay lines 52 then tilt the $S_r$ wavefront to perpendicular propagation 54 and the beam is photodetected and electrically vector summed. The delay lines, photodiodes, and corporate feed correspond to the reference manifold of shown in FIG. 4E of the '845 patent. It should be noted that for this one dimensional (1-D) design, the signal path for the input beam at $S_0$ to the output at $S_r$ undergoes a single electrical to optical to electrical (EOE) conversion. The system of FIG. 2 can be defined as a scan engine and be represented as shown in FIG. 3.

Referring to FIG. 4, a two dimensional (2-D) receiver beamformer design utilizing the teaching of the '845 patent can be accomplished by stacking the FIG. 3 scan engines in orthogonal planes. Each row of the antenna array is vector summed by a scan engine, then the row outputs are vector summed by a single scan engine in the vertical (column) direction. As such, now two EOE conversions are required in the signal path and numerous components are needed at the antenna backplane.

While the phased array antenna system as set forth in the '845 patent provides for a wideband phased array antenna system that has less beam squint than conventional antennas, there still exists, however, a need for not only a wideband phased array antenna system that has less beam squint than conventional antennas, but also one that employs a receiving system that has a less cumbersome implementation, needs minimal EOE conversion steps, and minimizes beamforming components needed at the antenna platform. The present invention as described hereinbelow provides such an antenna system.

SUMMARY OF THE INVENTION

In accordance with the present invention, an incoming electrical wavefront is received by an antenna. Laser light is amplitude modulated to provide a synthesized optical wavefront beam. The synthesized optical wavefront is mixed with the incoming electrical wavefront by optical modulation to provide a resultant optical waveform tilted to a coarse scan angle. The resultant optical waveform is transmitted to a predetermined delay line to provide an electrical output from the predetermined delay line corresponding to a main lobe of the resultant optical waveform.

In another aspect of the invention, a method of multibeam, multi-port phased array antenna beamforming is provided. An incoming electrical wavefront is received by an antenna. A plurality of laser light is amplitude modulated to provide a plurality of synthesized optical wavefront beams. The plurality of synthesized optical wavefronts is mixed with the incoming electrical wavefront by optical modulation to provide a plurality of resultant optical waveforms tilted to respective coarse scan angles. The plurality of resultant optical waveforms are transmitted to predetermined delay lines to provide electrical outputs from the predetermined delay lines corresponding to a main lobe of a respective one of the plurality of resultant optical waveforms.

In a further aspect of the invention, a method of multibeam, multi-port phased array antenna beamforming involving variable frequency is provided. An incoming electrical wavefront is received by an antenna. A plurality of laser light is variable frequency amplitude modulated to provide a plurality of variable frequency synthesized optical wavefront beams. The plurality of variable frequency synthesized optical wavefronts is mixed with the incoming electrical wavefront by optical modulation to provide a plurality of resultant optical waveforms tilted to respective coarse scan angles. The plurality of resultant optical waveforms is transmitted to predetermined delay lines to provide electrical outputs from the predetermined delay lines corresponding to a main lobe of a respective one of the plurality of resultant optical waveforms.

More particularly, in receive mode, the present invention synthesizes a 2-D phase wavefront which is carried to the antenna elements by amplitude modulated laser light within optical fibers. The synthesized wavefront is then mixed with the incoming wavefront by means of optical modulators located at each antenna element. The mixing process results in a fine phase scan which tilts the resultant wavefront to a coarse scan angle. Wavelength division multiplexing (WDM) is used to select the proper delay lines for final summing of the signals at a photodetector or photodetector array. Multiple beam operations also are made possible by WDM, so that both delay line selection and multiple beam separation at the photodetectors is accomplished simply by switching laser wavelengths.

BRIEF DESCRIPTION OF THE DRAWINGS

FIG. 9. shows the process implemented in accordance with one of the photonic downconversion optical modulators of FIG. 7.

DETAILED DESCRIPTION

Figure 5:
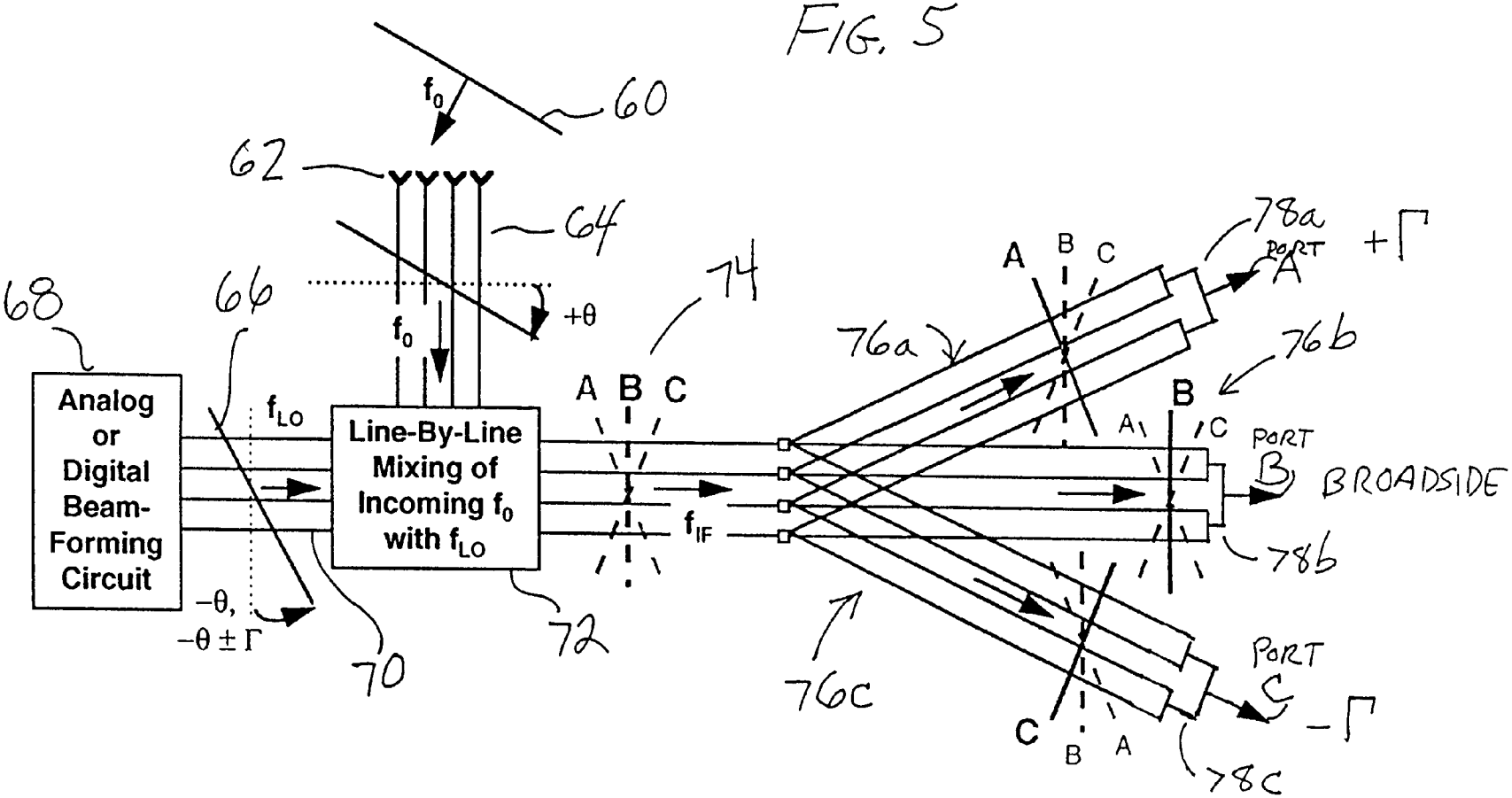
FIG. 5. shows a schematic block diagram overview of an embodiment in accordance with the present invention.

Referring to FIG. 5, a schematic block diagram overview of an embodiment of the present invention is shown. Wavefront 60 at frequency $f_o$ comes in to receive antenna array 62. Wavefront 60 is detected and then it travels down a set of feed lines 64 at a certain angle θ, i.e. the phase fronts all line up at angle θ.

Analog or digital beamforming circuit 68 generates local oscillator wavefront 66. Local oscillator wavefront 66 is tilted at an angle that is either −θ if the incoming angle is +θ, −θor −θ+/−Γ where Γ is one angle of the delay lines described below. Local oscillator wavefront 66 travels down feed lines 70.

Wavefront 60 and local oscillator wavefront 66 intersect one another in mixers 72 and there results line by line mixing of the local oscillator wavefront with the incoming wavefront. Such mixing: (1) upconverts or downconverts the $f_o$ frequency to an IF frequency; and (2) tilts the resultant IF wavefront 74 to a selected one of the angles of one of the delay lines.

IF wavefront 74 travels down delay lines 76*a*,76*b*, 76*c*and will line up with and be perpendicular to the direction of travel for one of the sets of delay lines. There is then an equal line feed 78*a*, 78*b*, 78*c*, at each end which then automatically vector sums whatever comes down the delay line. The one that is perpendicular to the direction of travel will be perfectly vector summed. The output of this delay line will correspond to the peak of the main lobe of received beam 60, and thus will provide the maximum signal, signal to noise ratio, and spurious-free dynamic range.

To reiterate the above processes in more detail, delay lines 76*a*, 76*b*, 76*c* are "Network Switched" delay lines at phase angles ±Γ and broadside (zero). The incoming wavefront at angle θ is mixed line-by-line with LO wavefront 66 to tilt the resulting IF wavefront to the closest delay line angle so that beam squint is minimized. Three possible IF tilt angles are shown which correspond to port phase angles +Γ, broadside, and −Γ, respectively. Assume that port A at phase angle +Γ is chosen. Once the wavefront is in the port A delay line 76*a*, the differential length between lines will tilt wavefront A to be perpendicular to its direction of propagation. The equal length (corporate) summing feed 78*a* at the end will vector sum the line signals into one and the output will correspond to the peak of the beam's main lobe. At ports B and C the wavefront A is not perpendicular to its direction of travel, so the beam is not perfectly summed by corporate feed 78*b*, 78*c* and the output will correspond to a portion of the beam offset in angle from the main lobe and a much lower signal level. Similarly, IF beams tilted to B and C correspondingly vector sum at ports B and C, respectively.

Figure 1:
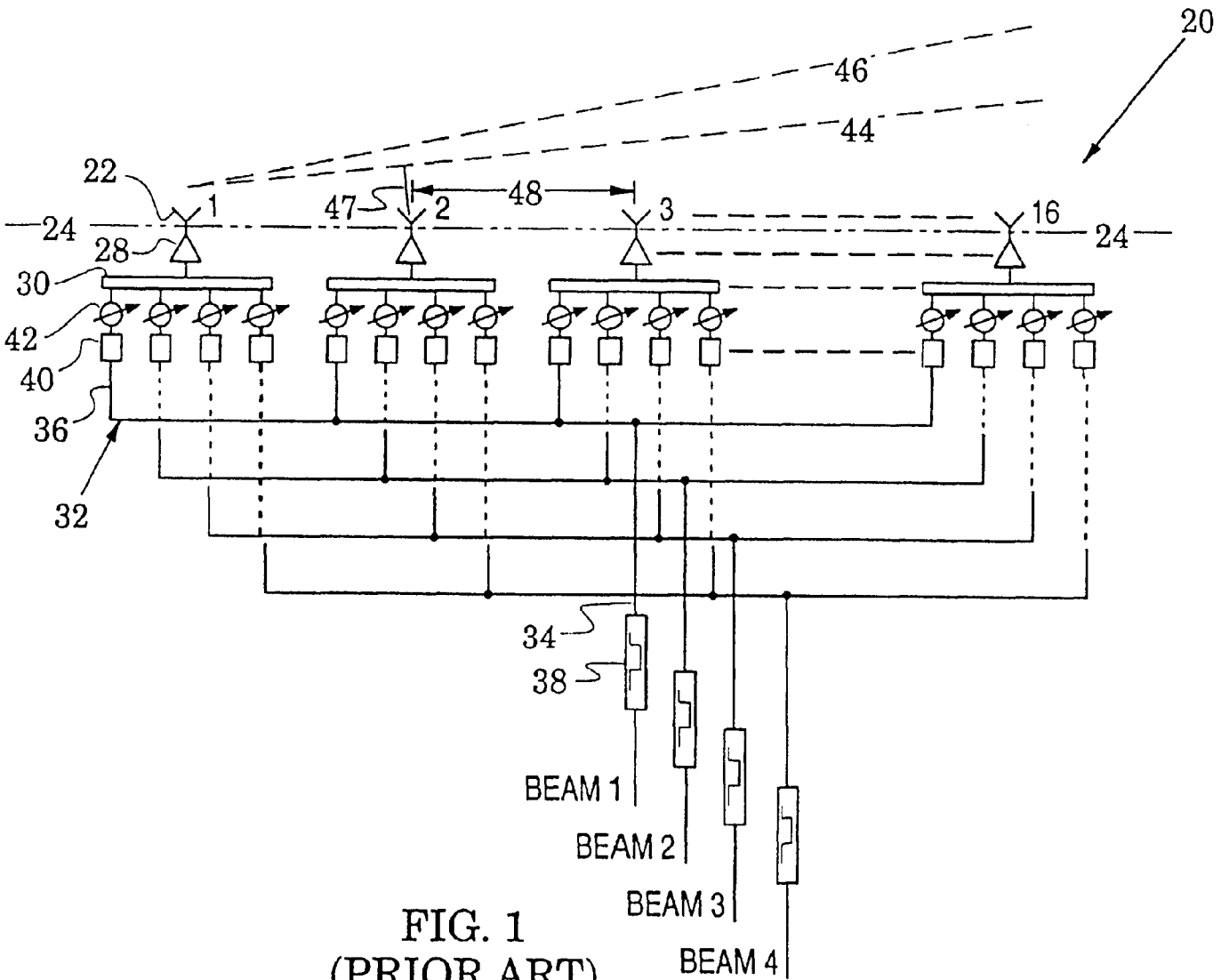
FIG. 1 (PRIOR ART)
FIG. 1 shows a portion of a prior art multibeam phased array antenna system.
Figure 2:
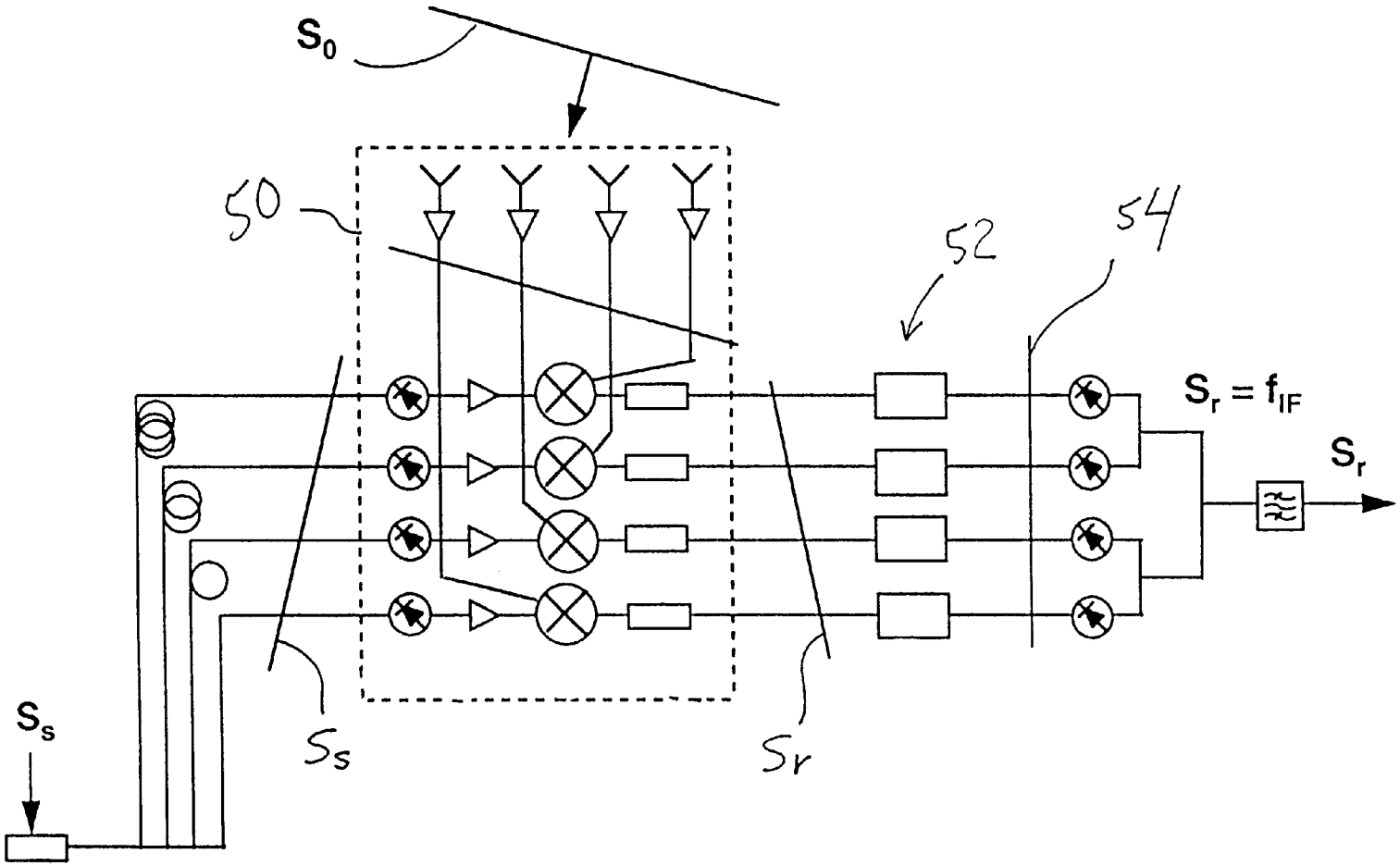
FIG. 2 (PRIOR ART)
FIG. 2 shows a prior art receiver implementation of a portion of a prior art multibeam phased array antenna system.
Figure 6:
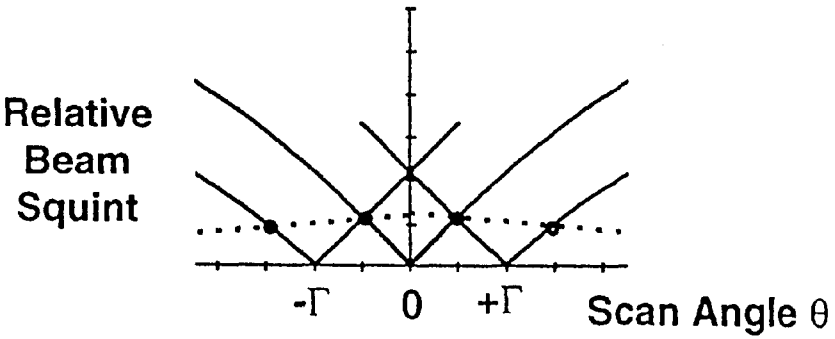
FIG. 6. shows a graph of how beam squint varies with scan angle in accordance with the present invention.
Figure 3:
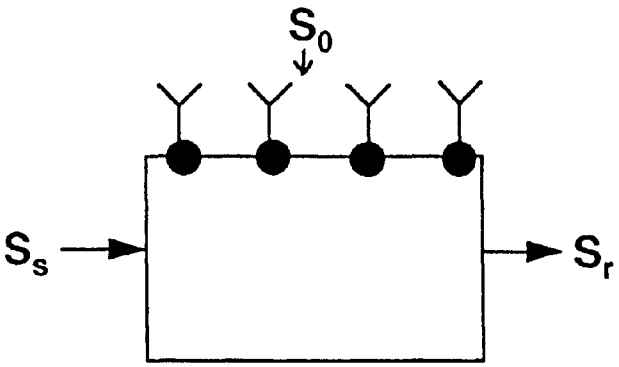
FIG. 3 (PRIOR ART)
FIG. 3 shows a schematic depiction of a prior art scan engine.
Figure 4:
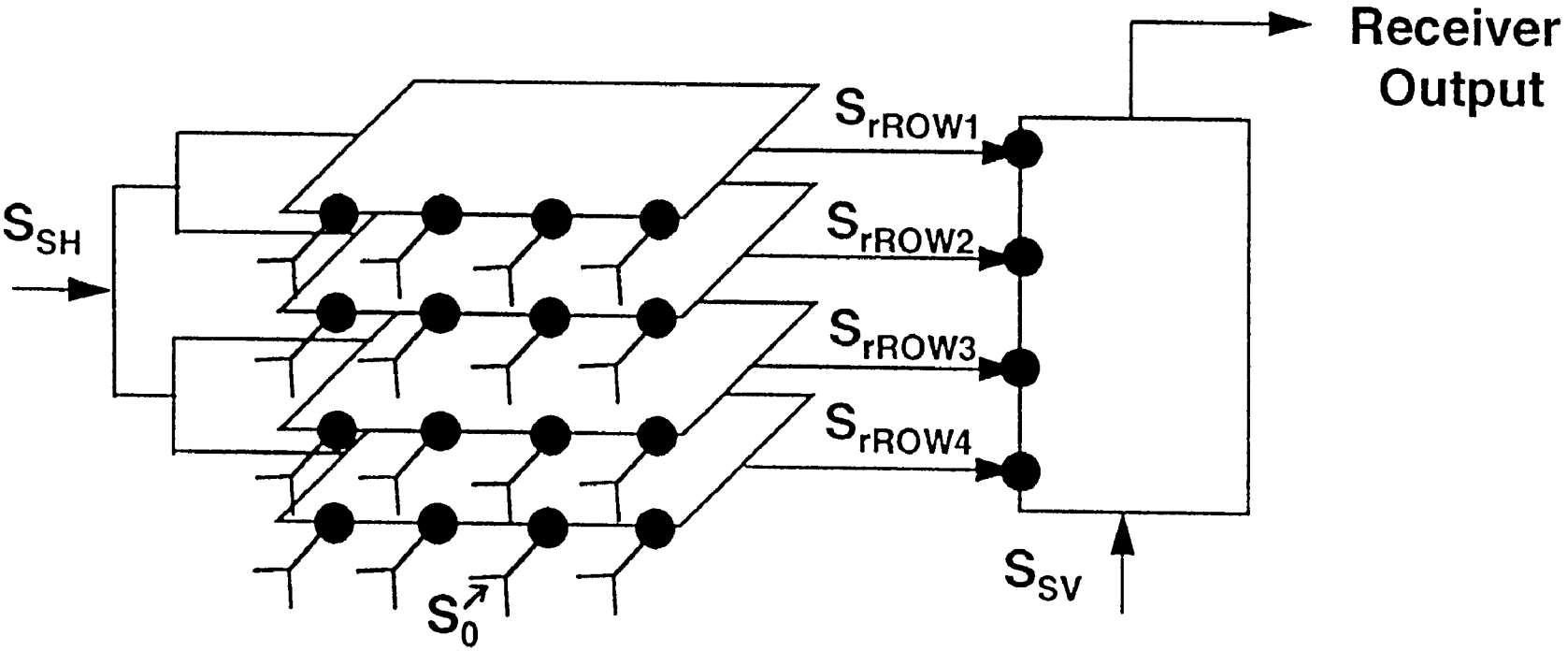
FIG. 4 (PRIOR ART)
FIG. 4 shows a schematic depiction of a prior art two dimensional receiver beamformer design.

The resulting beam squint is the same as the theory shown in the '845 patent. FIG. 6 shows how the squint varies with scan angle, being zero when the scan angle equals the Port angle (no fine scan required) and increasing as you move away from the Port angle (more fine scan required).

The system of FIG. 5 utilizes "Network Switched" delay lines, where the entire array of signal lines are switched into and out of the circuit, in order to better show how tilting the IF wavefronts results in summing the beam at the various delay line ports. An example of such a network is the Rotman lens and the fiber Rotman lens referred to in the '845 patent. Alternatively, "In-Line Switched" delay lines may also be used to perform the same function. An example of this type would be a binary fiber optic delay line as described by George W. Stimson "Introduction to Airborne Radar", 2nd Edition, SciTech Publishing, Mendham N.J., 1998, p 513. In this latter case proper selection of the in-line switches provides a differential length or time delay between each line to tilt the wavefront to be perpendicular to the direction of travel in a single set of lines. The corporate feed then gives a perfect vector sum and a beam output centered on the main lobe. Both of these delay line types were discussed in the '845 patent.

Figure 7:
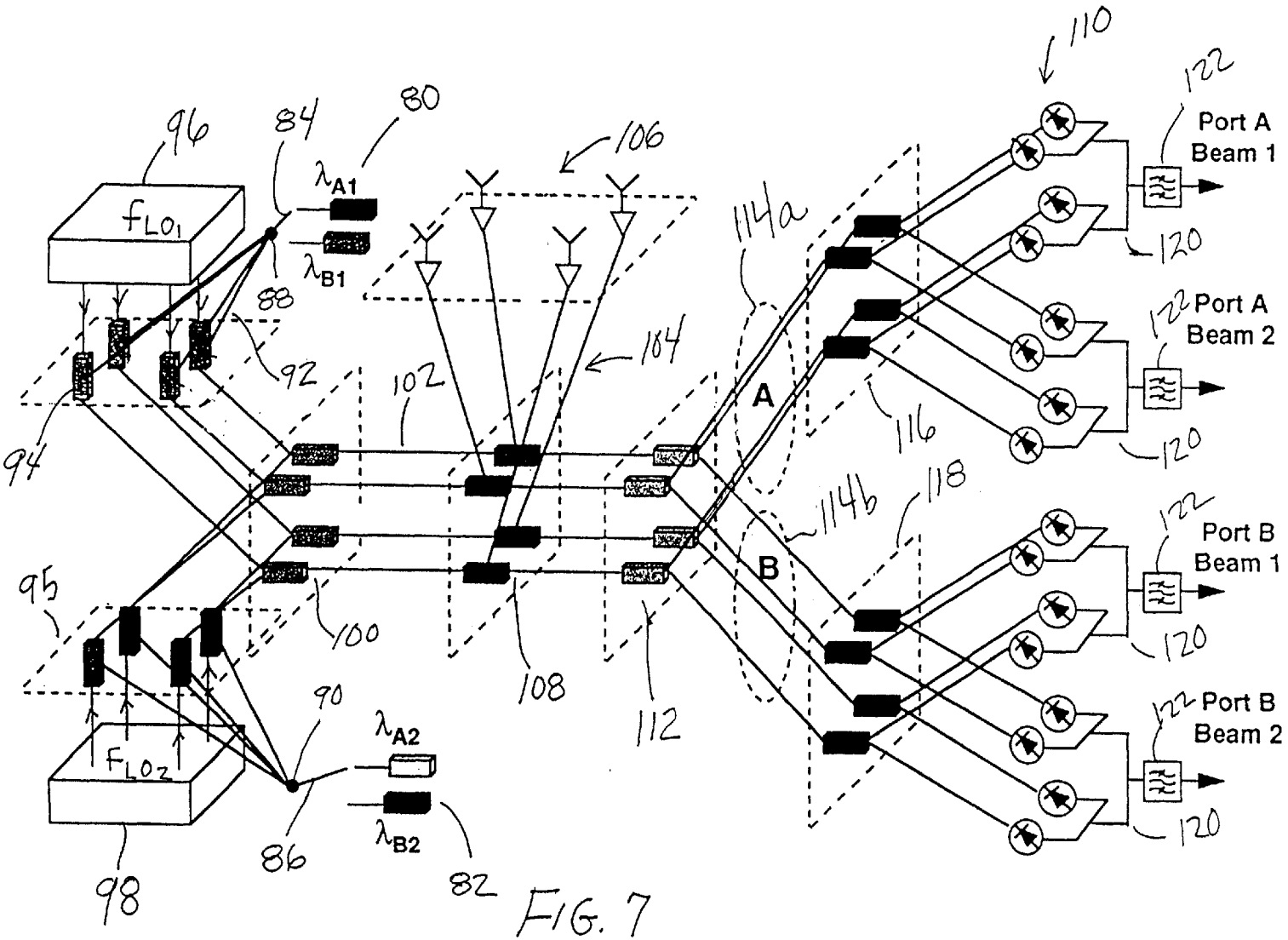
FIG. 7. shows a two dimension, two beam, four line, two port system for a 2×2 phased array antenna system embodiment of the present invention, FIG. 8. shows one of the corresponding individual fiber paths of FIG. 7 from input to output.
Figure 8:
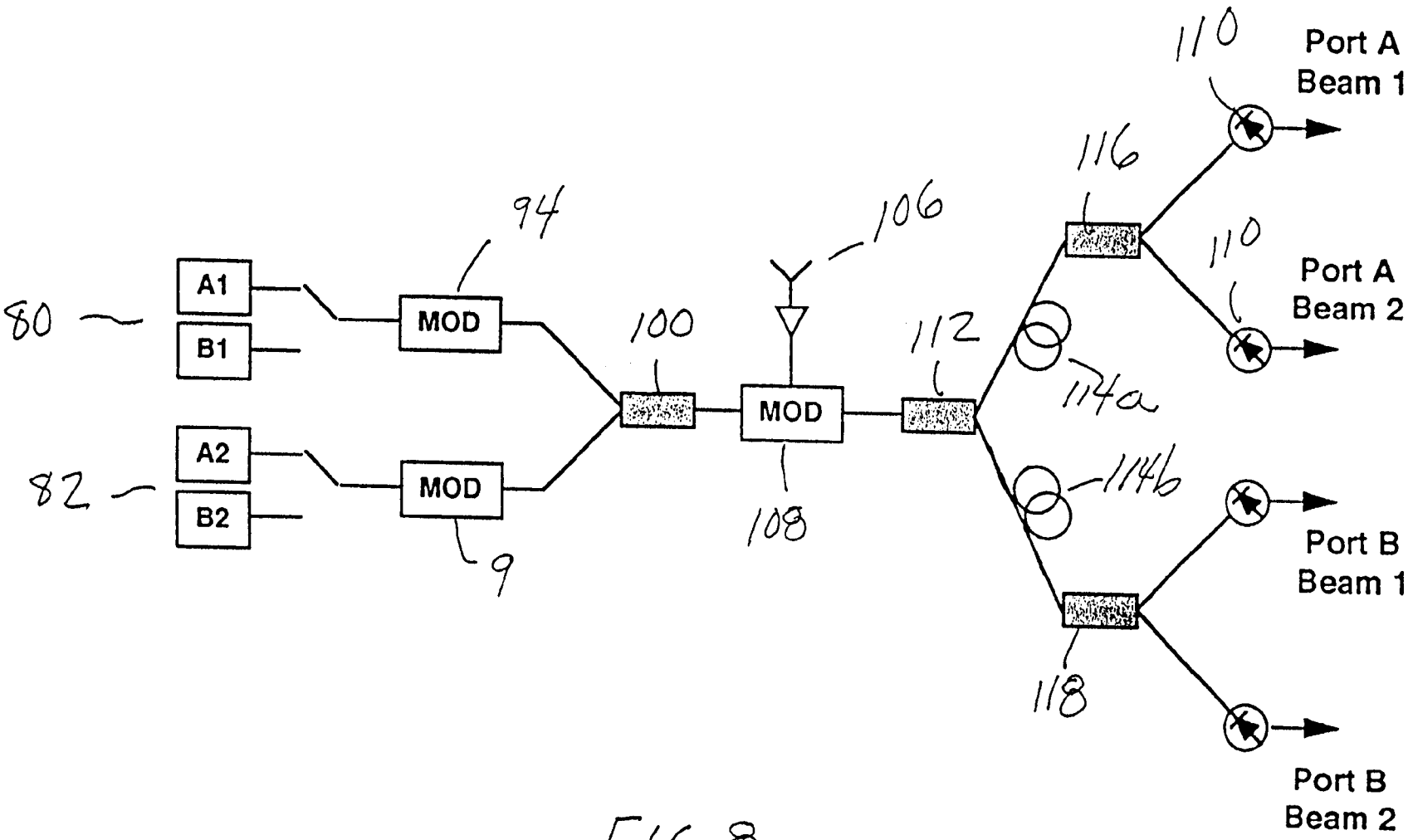

Referring collectively to FIGS. 7 and 8, there is shown in FIG. 7 *a* 2-D, 2-beam, 4-line, 2-port system for a 2×2 phased array antenna system embodiment of the present invention, while in FIG. 8 there is depicted one of the corresponding individual fiber paths from input to output of FIG. 7.

In FIG. 7, the 2-D array nature of the component arrangements is emphasized by the dashed parallelograms. Beam 1 lasers 80 at wavelengths λA1 and λB1 and beam 2 lasers 82 at wavelengths λA2 and μB2, for example, Panasonic 50 mW, 1550 nm model LNFE03YB lasers, are enabled depending upon which delay lines (delay Port A or delay Port B) are to be used. The lasers can be switched by optical switches 84, 86, such as JDS Fitel opto-mechanical switch type SW1:N, or, alternatively, connected to a common fiber line by 2×1 optical couplers and then electrically turned on and off. Whichever laser is on for each beam is then split by a 1×4 optical splitter 88, 90, for example, Canadian Instrumentation and Research Limited type 904P couplers, with each fiber 92, for example, Fujikura type SM-15-P-8/125-UV/UV-400 PM fiber, then passing to electro-optic modulators 94, 95 for example, Uniphase Telecommunications Products, Mach-Zehnder modulator type Mz-150-180-T-1-1-B modulators for 1550 nm operation at up to 18 GHz. Phased local oscillators 96, 98 apply via amplitude (intensity) modulation a respective phased local oscillator signal at $f_{LO1}$ and $f_{lO2}$. Any analog or digital means may be used to generate these phased signals which form the LO wavefronts for beams 1 and 2. FIG. 7 assumes that a single laser for each beam and port is externally modulated. Those skilled in the art can appreciate that another way, among others, of generating intensity modulated light is by direct modulation of the diode laser. In such a case, the phased LO signals would be applied directly to lasers located where the LO modulators are situated. All fibers are single mode polarization maintaining (PM) type. The fibers from each beam are combined together by 1×2 PM optical combiners/couplers 100, for example, Canadian Instrumentation and Research Limited type 904P couplers. The resultant single 2×2 array of fibers 102 with LO wavefronts for beams 1 and 2 then passes to an array of modulators 104 which receive signals from antenna array 106.

At modulator array 104 optical modulators 108, for example, Uniphase Telecommunications Products, Mach-Zehnder modulator type MZ-150-180-T-1-1-B LO modulators for 1550 nm operation at up to 18 GHz multiplies line by line the LO wavefront signal in each fiber by the incoming signal from each antenna element 106. The antenna signal is applied to the electrical port of the optical modulator, and the optical LO signal is applied to the fiber input. The multiplication process is equivalent to mixing, and produces sum and difference products. The mixing is accomplished at each antenna element by using the incoming wave at frequency $f_0$ to amplitude modulate the phase-bearing LO signal in each optical modulator. The modulation process multiplies the signals to give two mixing products. The phase of the LO is either added to or subtracted from the incoming wavefront phase. Here the phases differ for each antenna element, and the linear phase variation from element to element is what determines the wavefront angle. The resultant IF frequency wavefront at $f_{IF}=f_0 \pm f_{LO}$ can be tilted to any angle. The sum frequencies are usually filtered out downstream by photodetectors 110 and filters 122 so that only a frequency down-conversion takes place.

This optical/microwave mixing process is commonly referred to as "photonic down-conversion" and is discussed in detail in various papers on photonic down-conversion, such as: (1) G. K. Gopalakrishnan, W. K. Bums, and C. H. Bulmer, "Microwave-optical mixing in $LiNbO_3$ modulators," IEEE Transactions on Microwave Theory and Techniques, Vol. 41, NO. 12, December 1993. (2) R. T. Logan and E. Gertel, "Millimeter-wave photonic downconverters: Theory and demonstrations," Proceedings of SPIE Conference on Optical Technology for Microwave Applications VII, San Diego, Calif., Jul. 9–14, 1995. FIG. 9 of the present application depicts the process implemented in accordance with one of the photonic downconversion optical modulators 108 of FIG. 7 of the present application. The main result of applying this conversion is that for a modulation index of M=1, the insertion loss of the down-converting fiber link representing this process is only 6 dB worse than that of the same photonic link without the down-conversion. If a signal were down-converted in the electrical domain after photodetection, it would typically undergo a loss of at least 6 dB per down-conversion step. Therefore, including down-conversion as part of the optical process can be as efficient as the equivalent electrical process but will reduce parts count at the antenna. Very often more than one down-conversion step is needed when this is done in the electrical domain, whereas if done optically the down-conversion can be done in one step. So the overall loss for the photonic approach can be less.

Referring back to FIG. 7, after passing through down-conversion modulators 108, the signals are directed to the proper set of delay lines by port selection wavelength division multiplexers (WDMs) 112. These port selection WDMs have output passbands λA1+λA2 and λB1+λB2 for the respective ports A and B. After passing through delay lines 114*a*, 114*b* and having their respective IF wavefronts tilted perpendicular to the direction of propagation, the signals encounter the beam selection WDMs 116 and beam selection WDMs 118. WDMs 116 have output passbands λA1+λA2. WDMs 118 have output passbands λB1+λB2. This arrangement of port and beam selection WDMs directs the beam signals through the proper delay lines and to the correct set of photodetectors 110 simply by switching laser 80, 82 at the system input. After routing to the proper location, the respective beams are photodetected by photodetectors 110 and then summed electrically in equal-length corporate feeds 120. Filtering is then performed by filters 122 to remove the unwanted mixing product (usually removing the sum $f_o+f_{LO}$). Examples of WDMs include Photonics Integration Research Inc. type AWG (with various selectable wavelength ranges and spacings).

All of the fiber and electrical lines shown in FIG. 7 would have the same length except for the actual delay lines at A and B. This is necessary to preserve the relative microwave phases of the LO, RF antenna input, and down-converted IF signals as they pass through the system. Only in the delay lines do the lengths between one line and another differ, and these differences, ΔL, are determined by:

$$\Delta L = \frac{\Delta x v}{c}\sin\theta_{coarse}$$

where

Δx is antenna element spacing v is velocity of light in optical fibers c is velocity of light in vacuum $\theta_{coarse}$ is the coarse scan angle.

This is independent of $f_{LO}$ and microwave wavelength.

Also, it should be noted that in the signal path after down-conversion modulators 108, the optical fiber need not be PM any more (it was PM because the modulators need input of a given polarization which must be maintained as the light travels down the fibers). It can be regular single mode fiber, for example, Corning model SMF-28 fiber.

Further, it should be also noted that the insertion loss of a 1×N WDM is less than a 1'N splitter/coupler for N≧6 for current technology. Thus, if the system has a small number of beams or ports, i.e. N≦6, lower overall system loss can be achieved by replacing the WDMs in FIG. 7 by splitter/combiners. This may also simplify the wavelength ranges by reducing the number of wavelengths needed to pass a signal successfully through the system. An embodiment of the present invention has its greatest utility when the number of ports or beams is ≧6 with current WDM technology.

Figure 10:
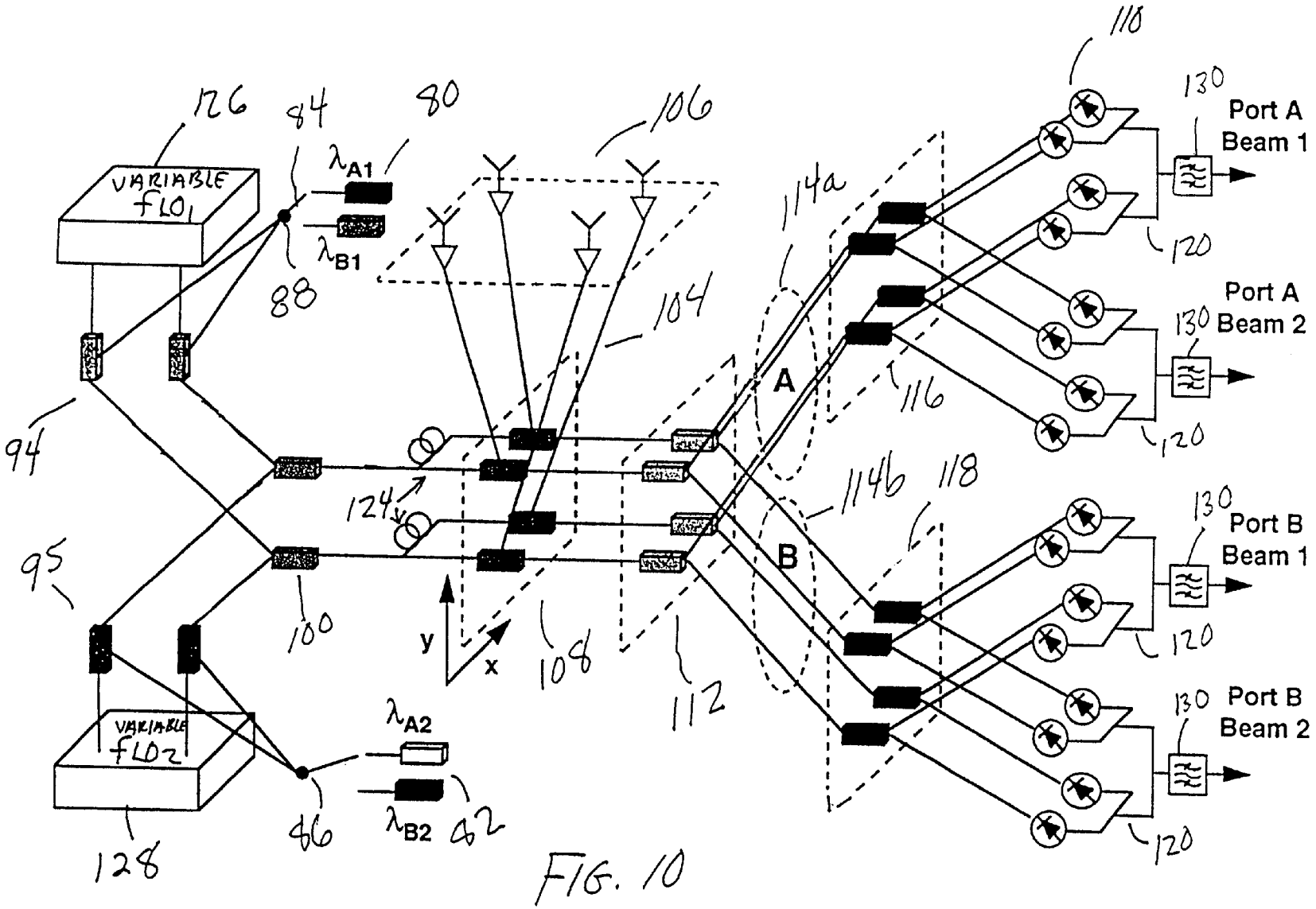
FIG. 10. shows an alternative two dimension, two beam, four line, two port system for a 2×2 phased array antenna system embodiment of the present invention.

Referring to FIG. 10, there is an alternative embodiment, similar to that depicted in FIG. 7, where similar components are similarly numbered. However, The number of LO modulators and optical combiners can be reduced significantly if a variable LO frequency approach is followed. Delay lines 124 are inserted in the x-direction between down-conversion modulators 108 which allows a 2-D LO wavefront to be formed using only a 1-D LO phased signal generator. For an N×N antenna array this reduces the number of LO modulators (and optical combiners) from $N^2$ to N which can be a significant cost reduction. However, one-dimensional variable LO frequency $f_{LO1}$ generator 126 and one-dimensional variable LO frequency $f_{LO2}$ generator 128, replace the counterpart 2 -D LO generators 96, 98 of FIG. 7. In addition, dynamic (tunable) filters 130 after photodetection replace filters 122 of FIG. 7, to track the resultant variable $f_{IF}$. This embodiment would be a preferred embodiment for very large arrays. In this embodiment, the y (vertical) phase differences between fibers, Δφy are produced by the 1-D, phased, variable $f_{LO}$ generators 126, 128 similar to what was done in 2-D for the embodiment of FIG. 7. That is, each modulator of set 94 or set 95 receives the same $f_{LO1}$ or $f_{LO2}$ but with a phase difference $\Delta\phi_{y1}$ or $\Delta\phi_{y2}$ between modulators. However, in this embodiment the required x (horizontal) phase differences $\Delta\phi_x$ are produced by varying $f_{LO}$ and then passing these signals through delay lines 124. The x phase difference will vary as $\Delta=2\pi f_{LO}\delta 1_x/v$ where $\delta 1_x$ is the length of delay lines 124 and v is the velocity of light in optical fiber. Varying $f_{LO}$ thus varies $\Delta\phi_x$, and the change in $f_{LO}$ required to produce a given $\Delta\phi_x$ can be made smaller by increasing δb $\mathbf{1}_x$. The antenna is easily scanned in 2-D using phased $f_{LO}$ generators 126, 128. First, the scan in the x direction is set by tuning a generator to an $f_{LO}$ needed to give the desired $\Delta\phi_x$. Then, at this fixed $f_{LO}$, the generator adjusts the $\Delta\phi_y$ to give the desired scan angle in the y direction.

There are practical limitations as to how large $\delta 1_x$ can be. As $\delta 1_x$ becomes larger, requirements on the frequency stability of $f_{LO}$ become more stringent if the fluctuations in scan angle are to be kept to tolerable levels. Thus, $\delta 1_x$ can be chosen only so large that the stability of system components, such as $f_{LO}$ frequency synthesizers 126, 128 and any system beam control circuitry do not produce excessive beam scan angle fluctuations. Thus, there will always need to be some variation in $f_{IF}$ as the beam is scanned in the x direction. However, the variations in $f_{IF}$ may be easily compensated for by the use of dynamic (tunable) filters 130. Also, if a fixed IF is desired, a second down-conversion step to $f_{IF2}$ may be added after filters 130. In this case, a second LO, at frequency $f_{LO2}=f_{IF}-f_{IF2}=f_0-f_{LO}-f_{IF2}$, would be varied in concert with $f_{LO}$ to produce the fixed $f_{IF2}$.

Therefore, in accordance with present invention a method and apparatus is provided which greatly simplifies an antenna system backplane when operated in the receive mode since it then requires no processing in the RF domain at the antenna. In receive mode, only two beamformer components—an optical modulator and a fiber delay line—are located at each antenna element. These components are low-weight, compact devices that consume low or no power. The rest of the system can be located remotely where power and cooling requirements are more easily accommodated. The mechanical and thermal design of both the antenna array and the remote facility are greatly simplified by an implementation of the present invention. Further, the present invention uses only a single electrical to optical to electrical (EOE) photonic conversion step in the information signal path for 2-D implementations. Previous 2-D wideband photonic beamformers required two photonic conversion steps because they employed 1-D scan engines stacked in orthogonal planes, such as that used in the '845 patent. The requirement of only a single EOE conversion step typically will result in a >30 dB improvement in system insertion loss and noise figure, and a 5 to 20 dB improvement in spurious free dynamic range compared to the architecture taught in the '845 patent.

What is claimed is:

1. A method of phased array antenna beamforming comprising the steps of:

receiving an incoming electrical wavefront by an antenna, said electrical wavefront having a phase front at a wavefront phase angle;

generating a local oscillator wavefront, said local oscillator wavefront having a phase front at a local oscillator phase angle;

mixing said electrical wavefront with said local oscillator wavefront to generate a resultant intermediate frequency wavefront;

transmitting said resultant intermediate frequency wavefront to a selected delay path of a plurality of delay paths, each delay path having a delay path phase angle and providing a delay path wavefront output; and vector summing the delay path wavefront output of the selected delay path, wherein said local oscillator phase angle is approximately equal to the negative of the wavefront phase angle added to the negative of the delay path phase angle of the selected delay path.

2. The method of claim 1, wherein the delay path phase angle of the selected delay path provides that the delay path wavefront output corresponds to the peak of a main lobe of the incoming electrical wavefront.

3. The method of claim 1, wherein each delay path comprises network delay lines.

4. The method of claim 1, wherein each delay path comprises in-line switched delay lines.

5. The method of claim 1, wherein the step of vector summing the delay path wavefront output comprises the step of coupling the delay path wavefront output to an equal length summing feed.

6. The method of claim 1, wherein the step of generating a local oscillator wavefront comprises the steps of:

providing one or more optical signals; and amplitude modulating the one or more optical signals to provide the local oscillator wavefront, and wherein the step of mixing said electrical wavefront with said local oscillator wavefront comprises mixing the local oscillator wavefront with the electrical wavefront by optical modulation to provide said resultant intermediate frequency wavefront.

7. A phased array antenna beamformer comprising:

an antenna for receiving an incoming electrical wavefront, said electrical wavefront having a phase front at a wavefront phase angle;

a beam-forming circuit providing a local oscillator wavefront, said local oscillator wavefront having a phase front at a local oscillator phase angle;

a mixer coupled to said antenna and said beam-forming circuit to mix said electrical wavefront with said local oscillator wavefront to provide a resultant intermediate frequency wavefront;

one or more selectable delay paths receiving said resultant intermediate frequency wavefront, each selectable delay path having a delay path phase angle and producing a corresponding delay path wavefront output; and one or more vector summers, each vector summer being coupled to a corresponding selectable delay path and receiving the corresponding delay wavefront output to produce a vector sum output, and wherein one of said selectable delay paths being selected and said local oscillator phase angle being approximately equal to the negative of the wavefront phase angle added to the negative of the delay path phase angle of the selected delay path.

8. The phased array antenna beamformer of claim 7, wherein at least one of the selectable delay paths comprises network delay lines.

9. The phased array antenna beamformer of claim 7, wherein at least one of the selectable delay paths comprises in-line switched delay lines.

10. The phased array antenna beamformer of claim 7, wherein at least one vector summer comprises an equal length summing feed.

11. The phased array antenna beamformer of claim 7, wherein the beam-forming circuit comprises:

one or more optical sources, each optical source producing an optical output; and one or more amplitude modulators modulating the optical outputs to produce the local oscillator wavefront, and wherein the mixer comprises an optical modulator.

12. A method of multi-beam, multi-port phased array antenna beamforming comprising the steps of:

receiving an incoming electrical wavefront by an antenna;

amplitude modulating a plurality of optical signals to provide a plurality of synthesized optical wavefront beams;

mixing selected ones of the plurality of synthesized optical wavefront beams with the incoming electrical wavefront by optical modulation to provide a selected resultant optical waveform tilted to respective coarse scan angles;

transmitting the selected resultant optical waveform to a selected predetermined delay line to provide an electrical output from the selected predetermined delay line to a selected one of a plurality of ports corresponding to a main lobe of the selected one of the plurality of resultant optical waveforms.

13. The method of multi-beam, multi-port phased array antenna beamforming of claim 12, wherein the step of amplitude modulating a plurality of optical signals includes the steps of:

providing a plurality of optical laser beams; and amplitude modulating the optical laser beams to provide the synthesized optical wavefront beams as local oscillator signals.

14. The method of multi-beam, multi-port phased array antenna beamforming of claim 13, wherein the step of mixing the plurality of synthesized optical wavefronts with the incoming electrical wavefront includes the step of multiplying the local oscillator signals with the incoming electrical wavefront to provide resultant optical waveforms having mixing product differences wherein a phase of the local oscillator signals are subtracted from a phase of the incoming electrical wavefront to form a plurality of resultant optical waveforms tilted to respective coarse scan angles.

15. The method of multi-beam, multi-port phased array antenna beamforming of claim 14, wherein the step of transmitting a selected resultant optical waveform to a selected predetermined delay line to provide an electrical output includes the steps of:

selecting the predetermined delay line coupled to an output port by wavelength division multiplexing to enable the resultant optical waveforms to be tilted perpendicular to a direction of propagation; and photodetecting the resultant optical waveforms.

16. A method of multi-beam, multi-port phased array antenna beamforming comprising the steps of:

receiving an incoming electrical wavefront by an antenna;

variable frequency amplitude modulating a plurality of optical signals to provide a plurality of variable frequency synthesized optical wavefront beams;

mixing selected ones of the plurality of variable frequency synthesized optical wavefront beams with the incoming electrical wavefront by optical modulation to provide a selected resultant optical waveform tilted to respective coarse scan angles;

transmitting the selected resultant optical waveform to selected predetermined delay lines to provide electrical outputs from the selected predetermined delay lines to a selected one of a plurality of ports corresponding to a main lobe of the selected one of the plurality of resultant optical waveforms.

17. The method of multi-beam, multi-port phased array antenna beamforming of claim 16, wherein the step of variable frequency amplitude modulating a plurality of optical signals includes the steps of:

providing a plurality of optical laser beams; and variable frequency amplitude modulating the optical laser beams to provide the synthesized optical wavefront beams as local oscillator signals.

18. The method of multi-beam, multi-port phased array antenna beamforming of claim 17, wherein the step of mixing selected ones of the plurality of variable frequency synthesized optical wavefronts with the incoming electrical wavefront includes the steps of:

delaying first variable frequency local oscillator signals with respect to second variable frequency local oscillator signals; and multiplying each of the variable frequency local oscillator signals with the incoming electrical wavefront to provide resultant optical waveforms having mixing product differences wherein a phase of the local oscillator signals is subtracted from a phase of the incoming electrical wavefront to form a plurality of resultant optical waveforms tilted to respective coarse scan angles.

19. The method of multi-beam, multi-port phased array antenna beamforming of claim 18, wherein the step of transmitting the selected resultant optical waveform to selected predetermined delay lines to provide electrical outputs includes the steps of:

selecting the predetermined delay line coupled to an output port by wavelength division multiplexing to enable the resultant optical waveforms to be tilted perpendicular to a direction of propagation; and photodetecting the resultant optical waveforms; and tunably filtering photodetected signals to track resultant variable frequency electrical output.

20. A phased array antenna beamformer comprising:

an antenna for receiving an incoming electrical wavefront, said antenna having a plurality of antenna elements;

a plurality of antenna feedlines, each antenna feedline coupled to a corresponding antenna element of the plurality of antenna elements to receive the incoming electrical wavefront, the electrical wavefront being distributed among the plurality of antenna feedlines to create antenna feedline signals having a wavefront phase angle;

a beam-forming circuit providing a plurality of local oscillator signals, said plurality of local oscillator signals providing a local oscillator wavefront having a phase front at a local oscillator phase angle;

a plurality of local oscillator feedlines, each local oscillator feedline receiving a corresponding local oscillator signal;

a mixer coupled to said plurality of antenna feedlines and said plurality of local oscillator feedlines, said mixer providing line by line mixing of the antenna feedline signals with the local oscillator signals to generate a plurality of intermediate frequency signals, said plurality of intermediate frequency signals providing a resultant intermediate frequency wavefront having a phase front at a intermediate frequency wavefront phase angle;

one or more selectable sets of delay lines, each set of delay lines comprising a plurality of delay lines and each delay line of each set of delay lines receiving a corresponding one intermediate frequency signal of the plurality of intermediate frequency signals, each set of delay lines applying a delay to the resultant intermediate frequency wavefront to provide a delayed wavefront with a delayed wavefront phase angle; and one or more equal length summing feeds coupled to each set of delay line, each equal length summing feed receiving the delayed wavefront output to produce a vector sum output, and wherein one of said selectable sets of delay lines being selected and said local oscillator phase angle being approximately equal to the negative of the wavefront phase angle added to the negative of the delayed wavefront phase angle of the selected set of delay lines.

21. The phased array antenna beamformer of claim 20, wherein the delayed wavefront phase angle of the selected set of delay lines provides that the delayed wavefront corresponds to the peak of a main lobe of the incoming electrical wavefront.

* * * * *